US005248021A

United States Patent [19]

Nichols

[11] Patent Number: 5,248,021

[45] Date of Patent: Sep. 28, 1993

[54] FALL ARREST LIFELINE ROOF ANCHOR

[76] Inventor: Steve Nichols, 21808 N.E. 175th, Woodinville, Wash. 98072

[21] Appl. No.: 880,140

[22] Filed: May 6, 1992

[51] Int. Cl.[5] ..... A62B 35/00

[52] U.S. Cl. ..... 182/3; 248/237

[58] Field of Search ..... 182/3; 248/237; 52/92, 52/93, 712, 702

[56] References Cited

U.S. PATENT DOCUMENTS

| | | | |
|---|---|---|---|
| 677,645 | 7/1901 | Elkins . | |
| 742,565 | 10/1903 | Berry . | |
| 3,217,833 | 11/1965 | Smith | 182/3 |
| 3,237,717 | 3/1966 | Jackson . | |
| 4,249,713 | 2/1981 | Glynn et al. | 182/3 X |
| 4,261,155 | 4/1981 | Gilb | 52/702 |
| 4,893,961 | 1/1990 | O'Sullivan et al. | 52/702 X |
| 4,932,173 | 6/1990 | Commins | 52/702 X |
| 5,143,171 | 9/1992 | Glynn et al. | 182/3 |

*Primary Examiner*—Alvin C. Chin-Shue

*Attorney, Agent, or Firm*—Christensen, O'Connor, Johnson & Kindness

[57] ABSTRACT

A bracket has downwardly-projecting parallel legs for embracing and being secured to opposite sides of a rafter and an upwardly-projecting central portion having an aperture for connection of a standard snaphook or carabiner to which a lifeline can be attached. The legs of the bracket can be interconnected by a bolt extending through or below the rafter. In addition or alternatively, the bottom end portions of the legs can be bent inward underneath the bottom of the rafter. The bracket is used in a fall prevention safety system in which the lifeline tethers a roofer or other worker to the anchor.

9 Claims, 12 Drawing Sheets

Fig. 4.
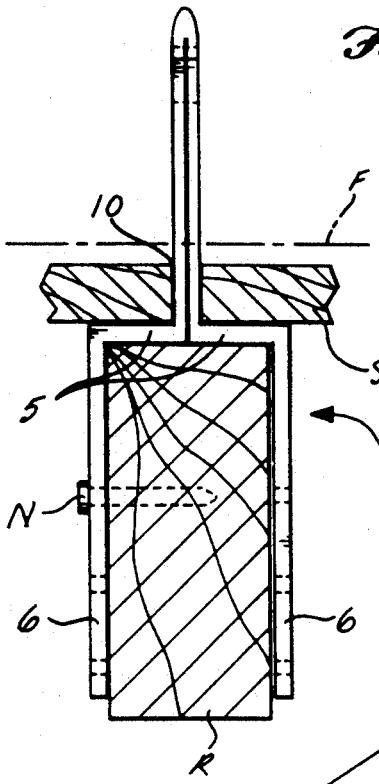
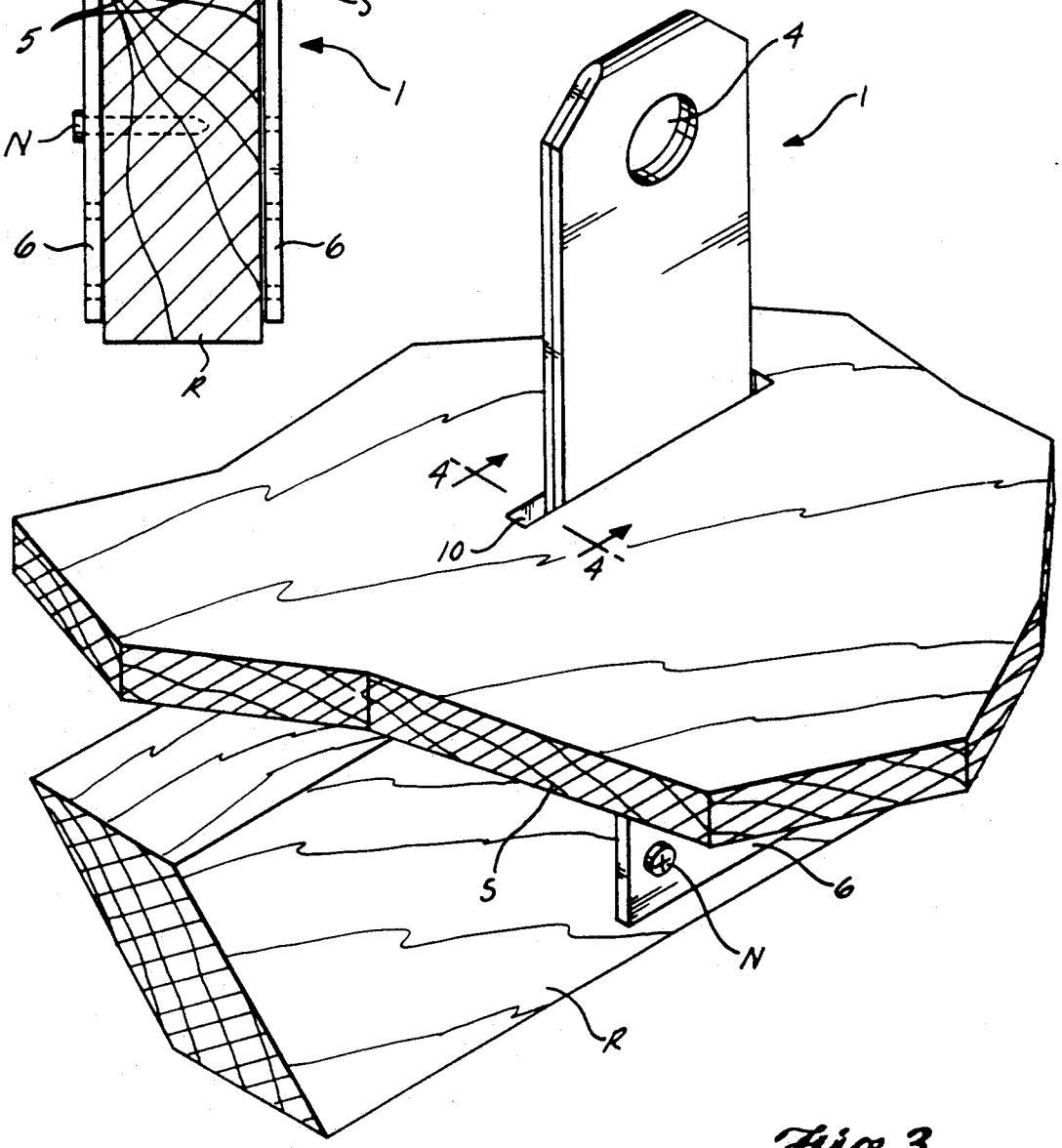
Fig. 3.

Fig. 6.
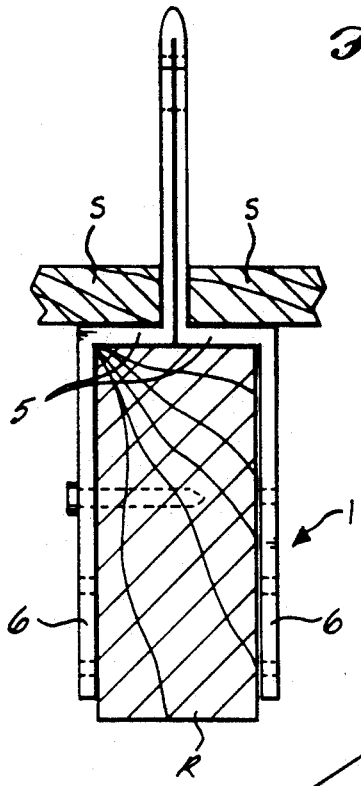
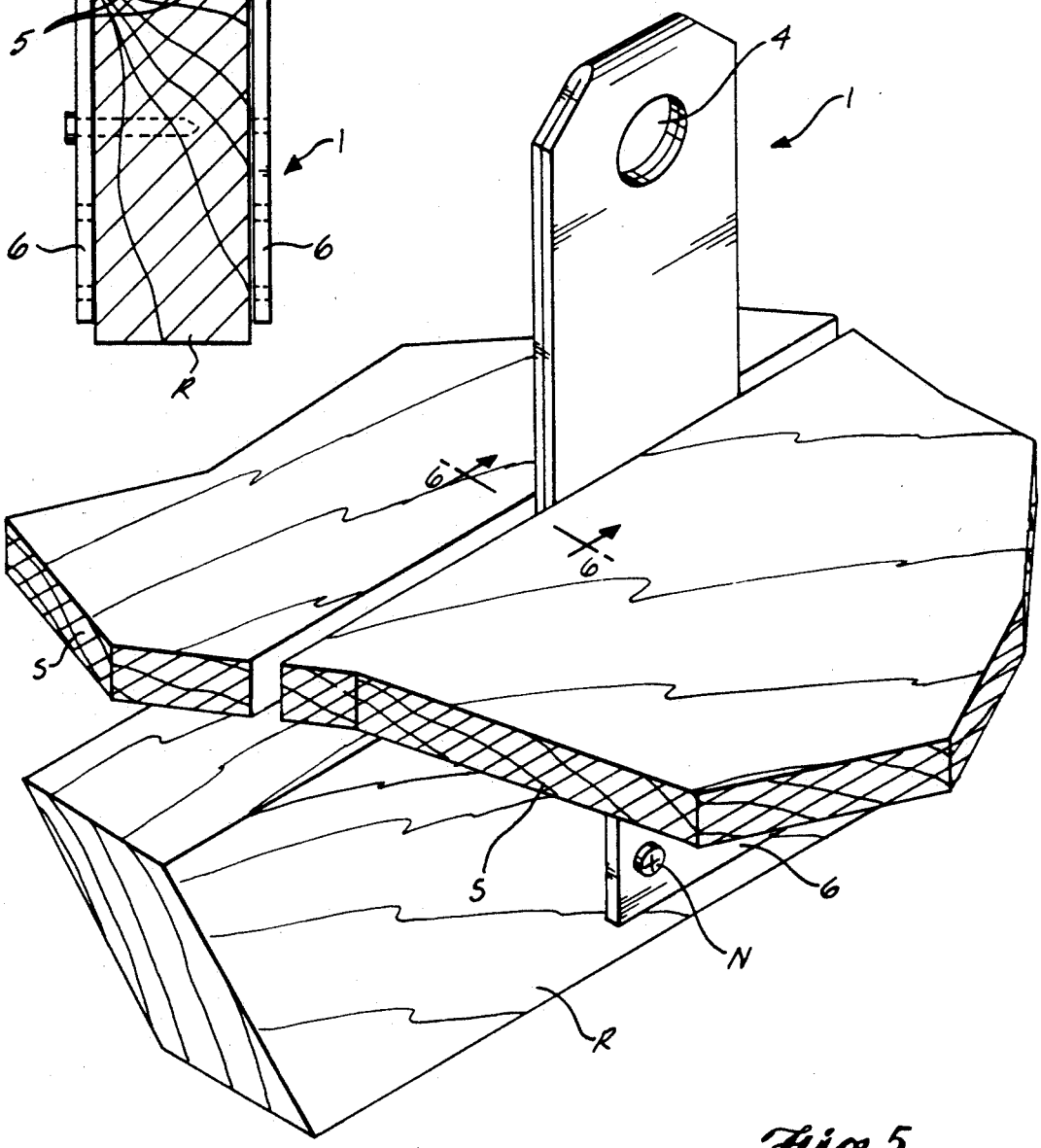
Fig. 5.

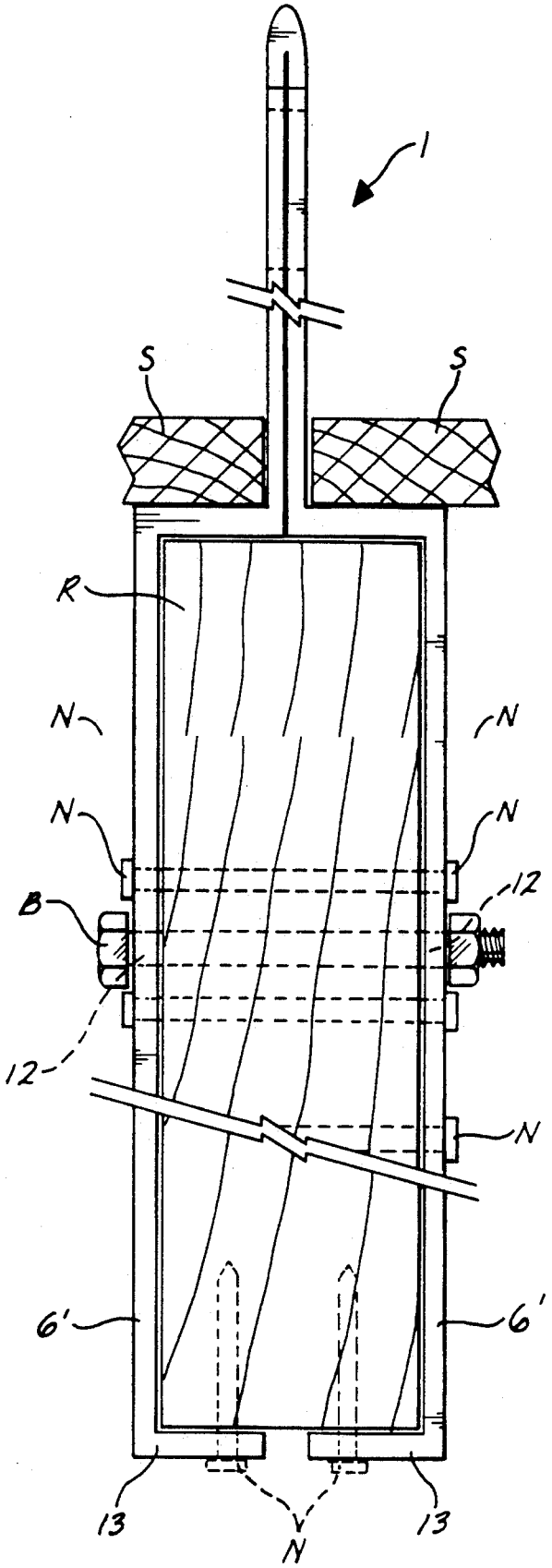
1
S
S
R
N
N
N
N
12
B
12
N
6'
6'
13
N
13

FALL ARREST LIFELINE ROOF ANCHOR

This application is related to my copending U.S. application Ser. No. 761,201, filed Sep. 13, 1991, U.S. Pat. No. 5,137,712, issued Aug. 11, 1992, titled "Fall Restraint Lifeline Roof Anchor," which is expressly incorporated by reference herein.

FIELD OF THE INVENTION

The present invention relates to a special bracket attachable to the understructure of a roof so as to serve as an anchor for a worker's lifeline.

BACKGROUND OF THE INVENTION

Government regulations often require fall prevention systems for roofers or others working on a roof. The requirements can vary depending on the pitch of the roof and the maximum slack in a lifeline that tethers the worker to an anchor member. Fall "restraint" systems may specify a prescribed minimum ratio, such as 4:1, of anchor strength to worker's weight for a prescribed amount of maximum slack in the lifeline. More stringent fall "arrest" regulations may for roofs of higher pitches or safety systems allowing greater freedom of the worker, i.e., greater slack in the lifeline. Regulations written specifically for roofers may be equally applicable to other workers supported on the roof after the finish roofing has been installed.

Glynn et al. U.S. Pat. No. 4,249,713, issued Feb. 10, 1981, discloses a specialized anchor formed of flat metal strap with long opposite end portions angled relative to each other to fit over the ridge of a roof understructure. Such angled end portions are intended to be positioned over inclined rafters at opposite sides of the ridge and have holes for nailing such opposite end portions to the rafters. The central portion of the anchor is return bent and has registered holes for a snap hook to which a lifeline can be attached. At the end of the roofing procedure, Glynn et al. proposed that the central portion of the anchor be bent over and covered by the ridge cap.

Jackson U.S. Pat. No. 3,237,717, issued Mar. 1, 1966, discloses a complicated safety rigging for roofers in which opposite ends of guidelines are anchored to the ground at opposite sides of a building structure.

Berry U.S. Pat. No. 742,565, issued Oct. 27, 1903, discloses a scaffold supported on an inclined roof by a "z-shaped hook" which includes one leg hooked over the ridge of the roof.

Similarly, Elkins U.S. Pat. No. 677,645, issued Jul. 2, 1901, discloses a shingler's carriage suspended from special hinged hooks which are affixed to a roof at the ridge.

SUMMARY OF THE INVENTION

The principal object of the present invention is to provide an anchor for a safety lifeline which allows a roofer to be tethered to the anchor safely, which meets some of the more stringent government regulations, which can be installed conveniently and quickly in standard roof construction without requiring special tools or application procedures, which does not require special procedures for extraction but which preferably remains functional as a lifeline anchor after roofing has been completed, and which is sufficiently inexpensive so as to be cost effective for a variety of roofing jobs.

In the preferred embodiment of the present invention, the foregoing object is accomplished by providing an anchor in the form of a bracket having parallel legs for embracing a rafter and an apertured upwardly projecting central portion for connection of a standard snap hook or carabiner to which a lifeline can be attached. The legs of the bracket preferably have preformed nail holes for convenient securing of the legs to the rafter. Larger registered holes can be provided for a bolt extending transversely through the rafter and the legs. The bottom end portions of the legs can be bent inward underneath the bottom of the rafter providing greater strength and resistance to twisting or swinging movement of the bracket relative to the rafter. Alternatively, the legs can extend downward substantially below the bottom of the rafter and have registered holes in the projecting portions of the legs for a bolt fitted close beneath the bottom of the rafter. Alternative bolt holes can be provided for rafters of different sizes and for different methods of installation of the bracket.

BRIEF DESCRIPTION OF THE DRAWINGS

FIG. 3 is a top perspective of the anchor of FIGS. 1 and 2 installed on a roof rafter with sheathing applied over the anchor and rafter;

FIG. 4 is a vertical section along line 4—4 of FIG. 3;

FIG. 5 is a top perspective of the anchor of FIGS. 1 and 2 installed on a roof rafter, showing an alternative installation of roof sheathing over the anchor and rafter;

FIG. 6 is a section along line 6—6 of FIG. 5;

FIG. 10 is an end elevation of another modified form of fall arrest lifeline roof anchor in accordance with the present invention installed on a rafter below roof sheathing, with the rafter shown in section;

DETAILED DESCRIPTION OF THE PREFERRED EMBODIMENTS

Figure 1:
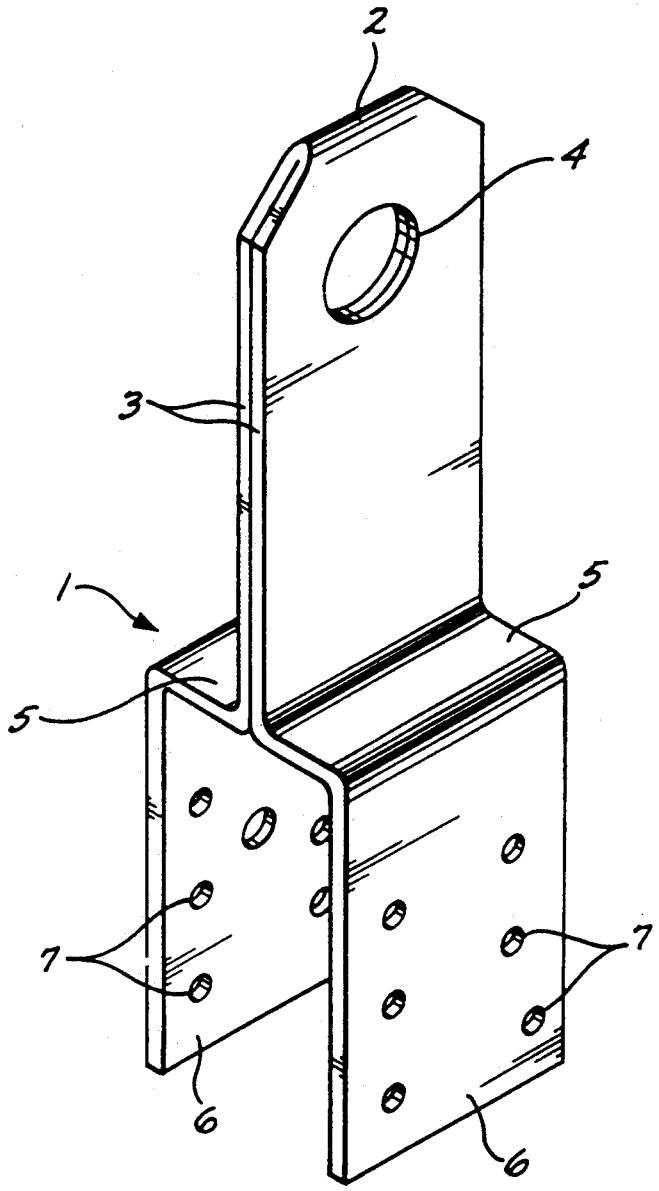
FIG. 1 is a top perspective of a fall arrest lifeline roof anchor in accordance with the present invention.

With reference to FIG. 1, a fall arrest lifeline roof anchor 1 in accordance with the present invention preferably is in the form of a bracket formed of a continuous strap of strong sheet metal material such as cold rolled or heat-treated steel. The bracket strap has a return bend 2 at its center such that facing surfaces of the central portions 3 of the bracket strap are in contiguous engagement. Such central portions have registered apertures 4. The opposite end portions of the strap are bent perpendicularly outward forming shoulders 5. From such shoulders the strap ends are bent perpendicularly downward so as to form transversely spaced parallel legs 6. Preferably each leg has several small through holes 7.

Figure 2:
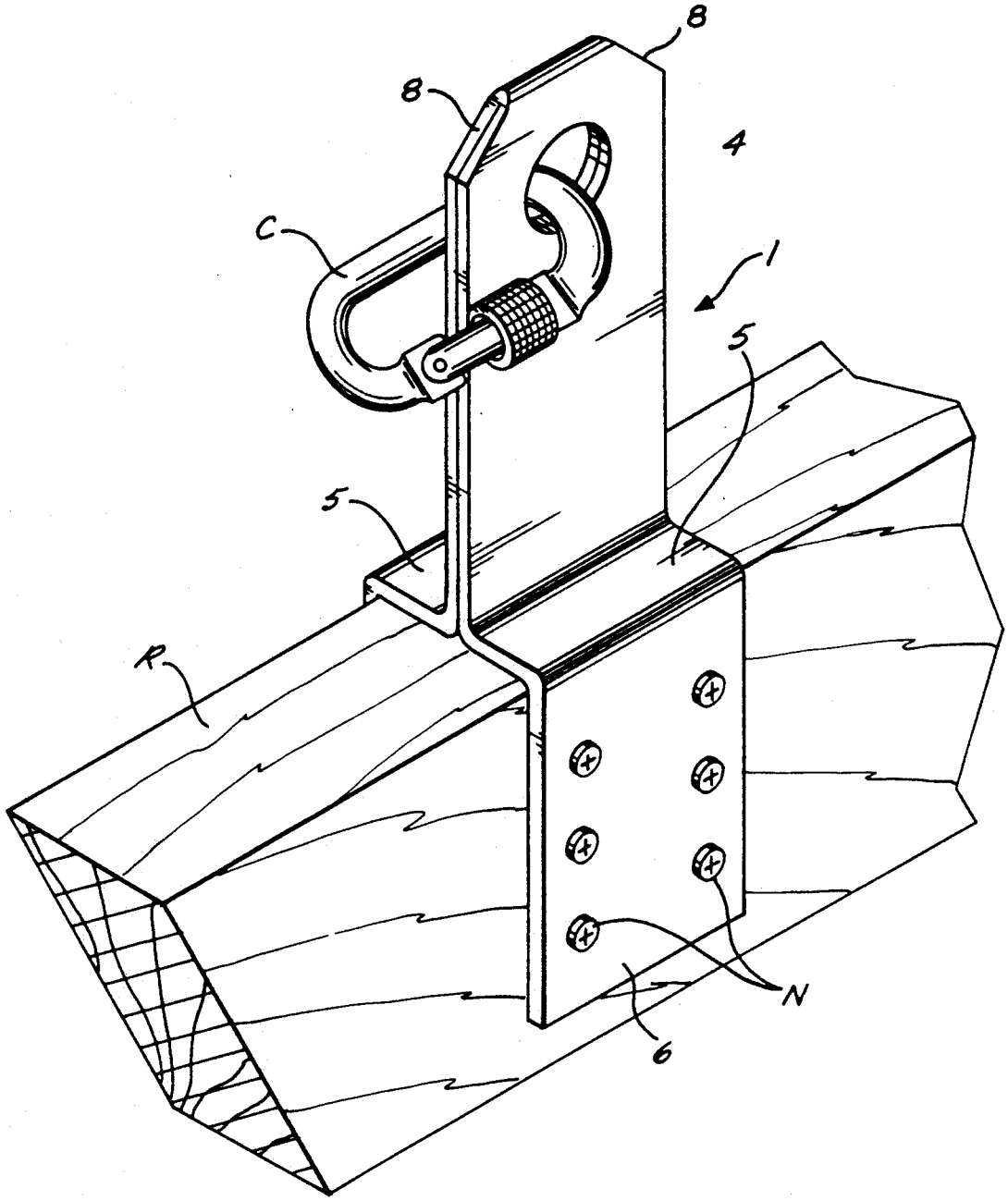
FIG. 2 is a top perspective of the anchor of FIG. 1 fitted over a roof rafter.

The anchor of FIG. 1 can be applied to a roof rafter R as shown in FIG. 2. Legs 6 are simply fitted downward over the rafter until the rafter engages against the undersides of the aligned shoulders 5. The anchor can be secured in position by nails N driven through the holes of the legs 6. A snap hook or carabiner C can be fitted in the registered apertures 4 for connection of a worker's lifeline which can extend to a suitable rope grab device worn by the worker. Preferably the upper corners of the anchor have bevels 8 so as not to interfere with swinging movement of the snap hook or carabiner relative to the central portion of the strap.

With reference to FIGS. 3 and 4, after installation of the anchor 1 in the manner described above, roof sheathing can be applied over it such as by cutting a slot 10 in a sheathing sheet S and fitting the sheet downward over the anchor so as to rest on top of the anchor shoulders 5 and rafter R. Alternatively, as illustrated in FIGS. 5 and 6, the anchor can be positioned at a location of a joint between sheathing sheets S which can abut at approximately the center of the rafter R so that cutting of a slot in a sheathing sheet is not required.

Figure 7:
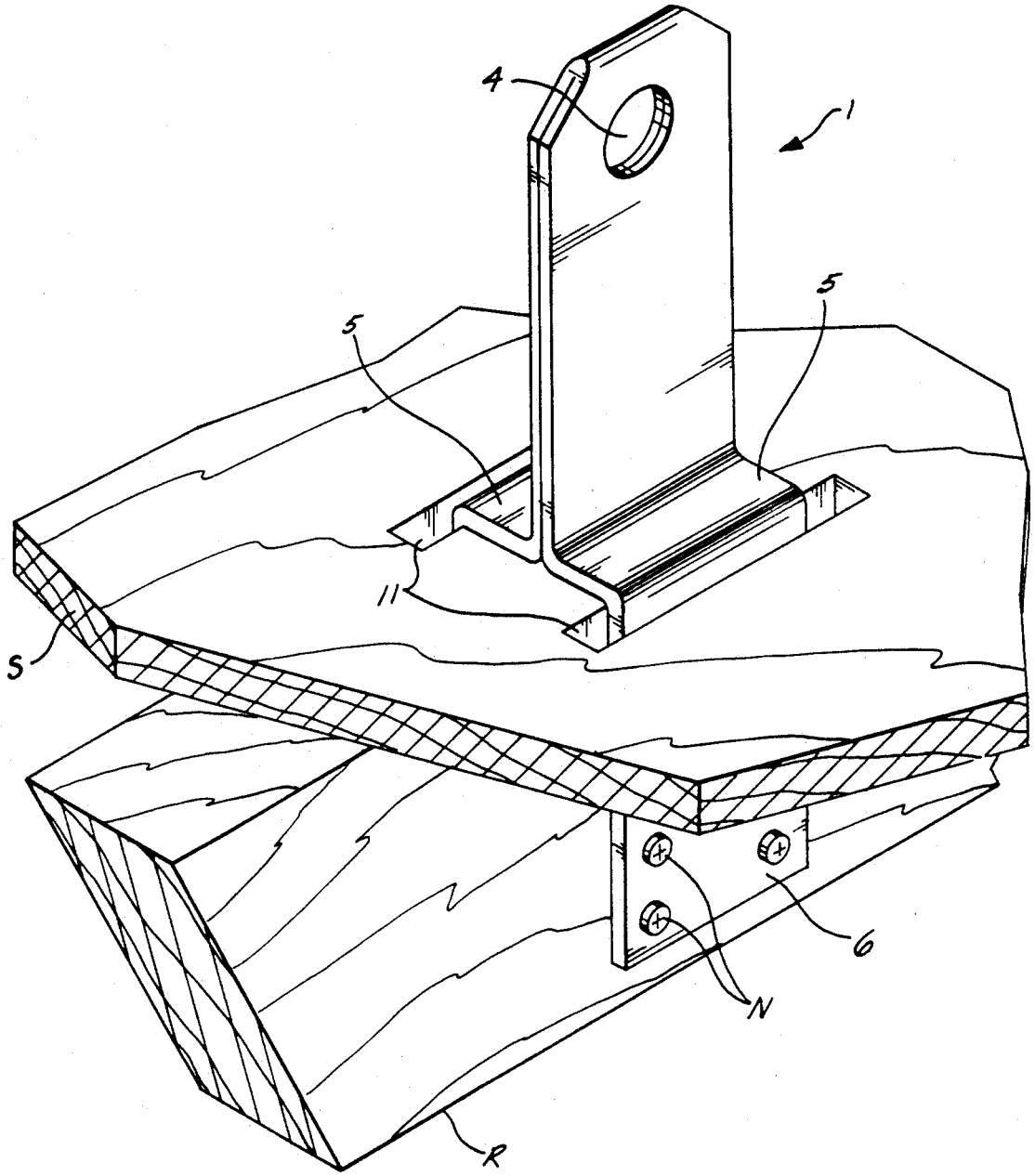
FIG. 7 is a top perspective of the roof anchor of FIGS. 1 and 2 installed through roof sheathing and onto a rafter.

With reference to FIG. 7, another option is to install the anchor 1 after the sheathing has been applied. In that case, slots 11 are cut through the appropriate sheathing sheets which were previously installed on the rafter R. Legs 6 of the anchor 1 can be inserted downward through such slots 11 until the shoulders 5 of the anchor engage against the upper surface of sheet S. Nails N then can be driven through the holes in the legs and into the rafter to secure the anchor in position.

Regardless of the procedure used for installing the anchor, it withstands application of greater force at the location of the registered apertures 4 than the fall restraint anchor shown in my co-pending application, Ser. No. 761,201, and therefore meets more stringent government regulations. Preferably, appropriate flashing and finish roofing F (FIG. 4) is applied around the anchor so that it becomes a permanent fixture and is usable by workers on the roof after the roofing project has been completed, in addition to being usable during application of the roofing.

Figure 8:
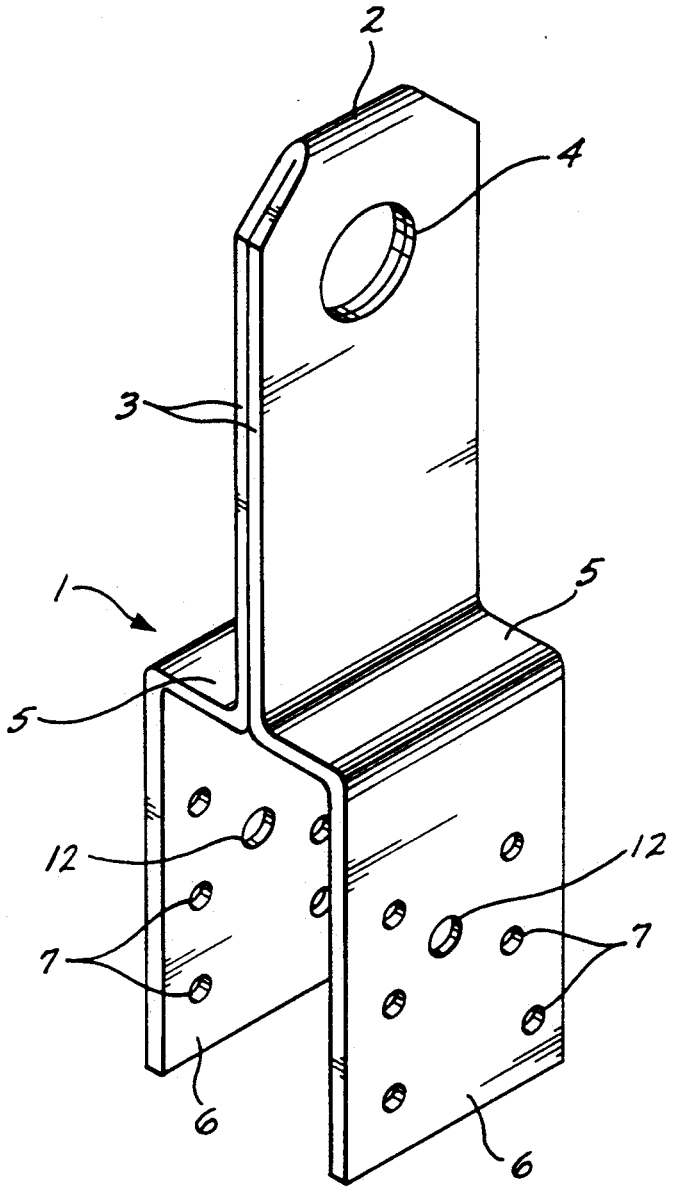
FIG. 8 is a top perspective of an alternative form of fall arrest lifeline roof anchor in accordance with the present invention.
Figure 9:
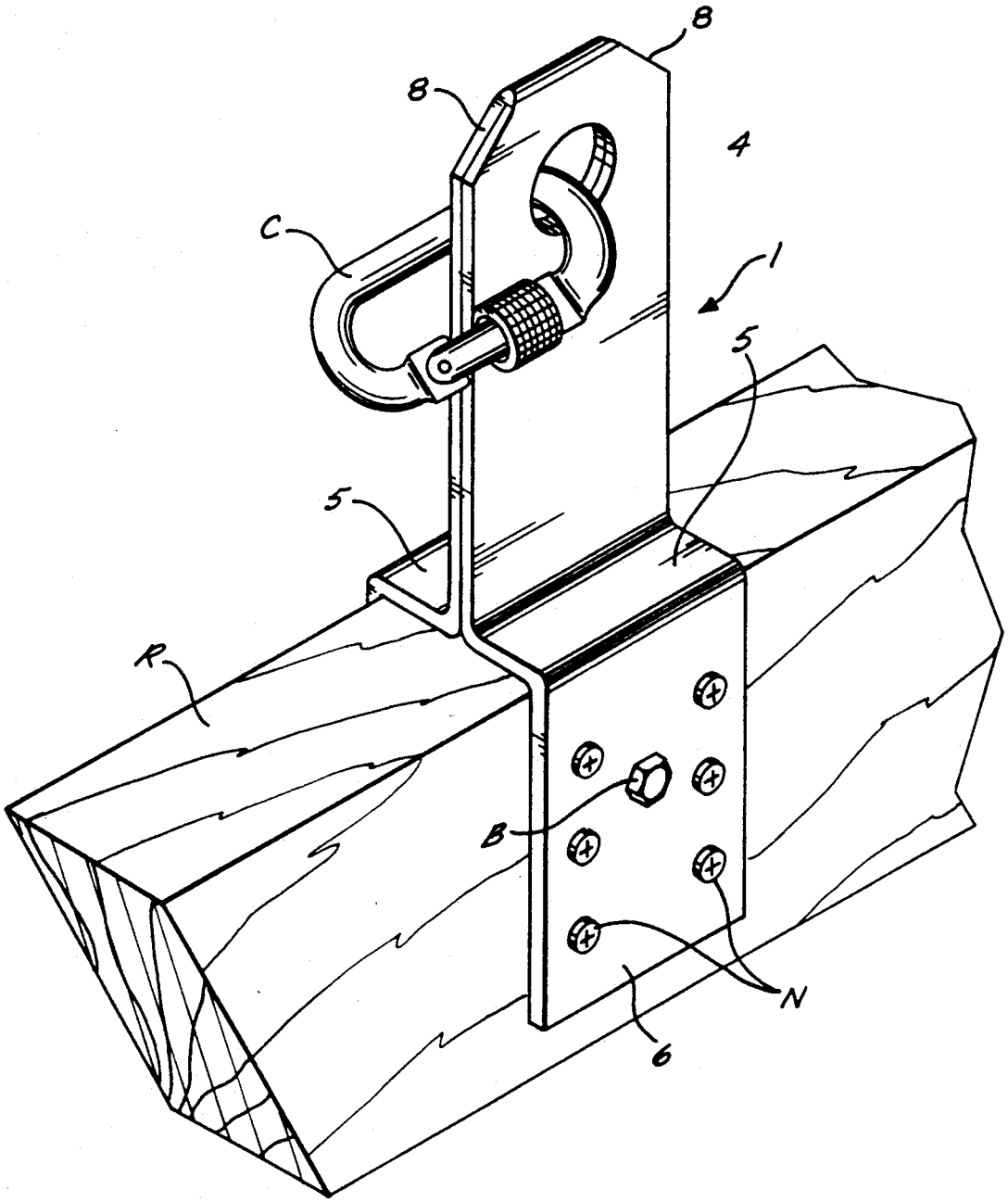
FIG. 9 is a top perspective of the anchor of FIG. 8 installed on a roof rafter.

While the form of the invention shown in FIG. 1 installed in any of the manners described above withstands greater pull-out force than other known anchors, nevertheless, when a large force is applied in a direction parallel to the length of the rafter, a strong shearing action is transmitted to the nails through the anchor member legs as the anchor tends to swing relative to the rafter. In addition, transverse force may tend to spread the legs apart, making the anchor more susceptible to pullout. In the modified form of anchor in accordance with the present invention, shown in FIG. 8, a larger aperture 12 is provided at about the center of each leg 6. The anchor is fitted over a rafter R as illustrated in FIG. 9, and a bore is drilled through the rafter in alignment with the larger apertures. A bolt B has its shank received in such bore and the registered larger central apertures. The bolt interconnects the legs, prevents the legs from spreading apart and rigidifies the installation so as to increase the pull-out force that the installed anchor will withstand. In other respects, the embodiment of FIGS. 8 and 9 is identical to the first described embodiment; and the embodiment of FIGS. 8 and 9 can be installed above roof sheathing as well as below it.

In the embodiment illustrated in FIG. 10, the legs 6' of the anchor are longer and are bent perpendicularly inward at the bottom so as to be positioned close beneath the underside of the rafter R. The inward-extending portions 13 of the legs can have one or more holes for nails N driven vertically upward to secure such portions in position. Because of the engagement of such portions against the underside of the rafter, there is less tendency of transmitting shearing force to the horizontal nails through the legs 6', and there also is less tendency of the legs to spread apart because of the vertical nails driven upward through the inward-extending portions 13. As also illustrated in FIG. 10, legs 6' can have central apertures 12 for a bolt B extending through such apertures and an aligned bore in the rafter for even greater strength.

Figure 12:
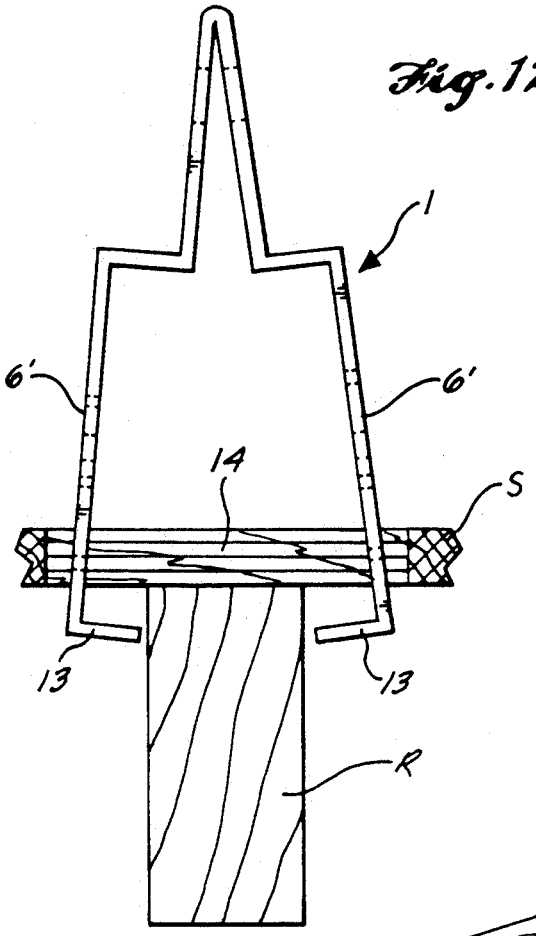
FIG. 12 is a section along line 12—12 of FIG. 10 but with the anchor fitted only partway onto the rafter.
Figure 11:
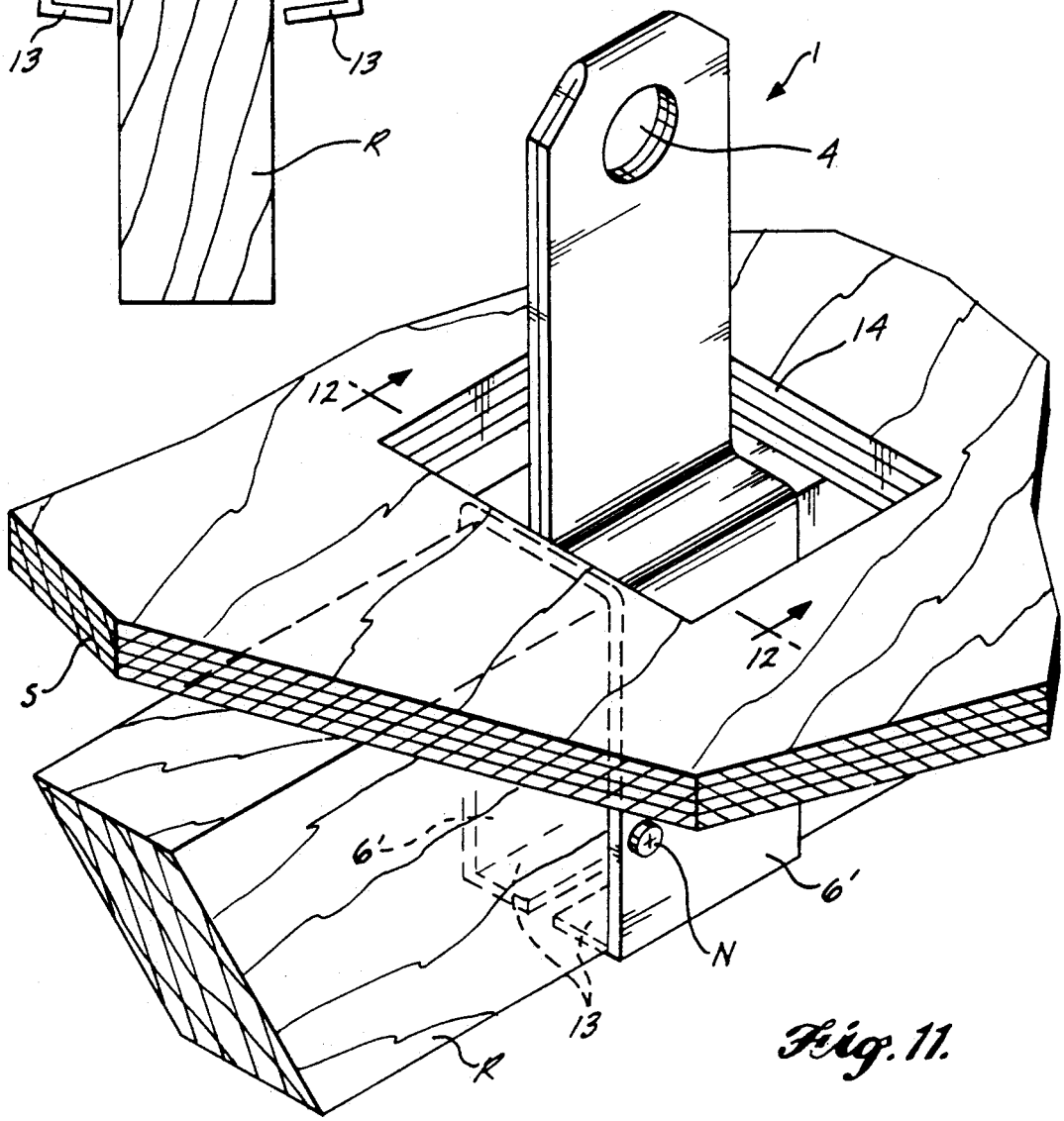
FIG. 11 is a top perspective of the anchor of FIG. 10 installed on a rafter subsequent to installation of the roof sheathing.

In order to install the modified anchor 1 shown in FIG. 10 before installation of the roof sheathing, it is only necessary to spread the legs 6' apart sufficiently that the legs can be fitted downward over the rafter. The natural resilience of the metal strap material causes the legs to spring back together when the inward-extending portions 13 pass beneath the underside of the rafter. The modified anchor shown in FIG. 10 also can be installed after installation of the roof sheathing, as illustrated in FIGS. 11 and 12. In that case a rectangular opening 14 must be cut in the sheet S at an area overlying the rafter (or aligned side notches in adjacent sheets in the case of a joint falling on the rafter) such that the anchor legs 6' will fit through the opening 14 as illustrated in FIG. 12.

Figure 13:
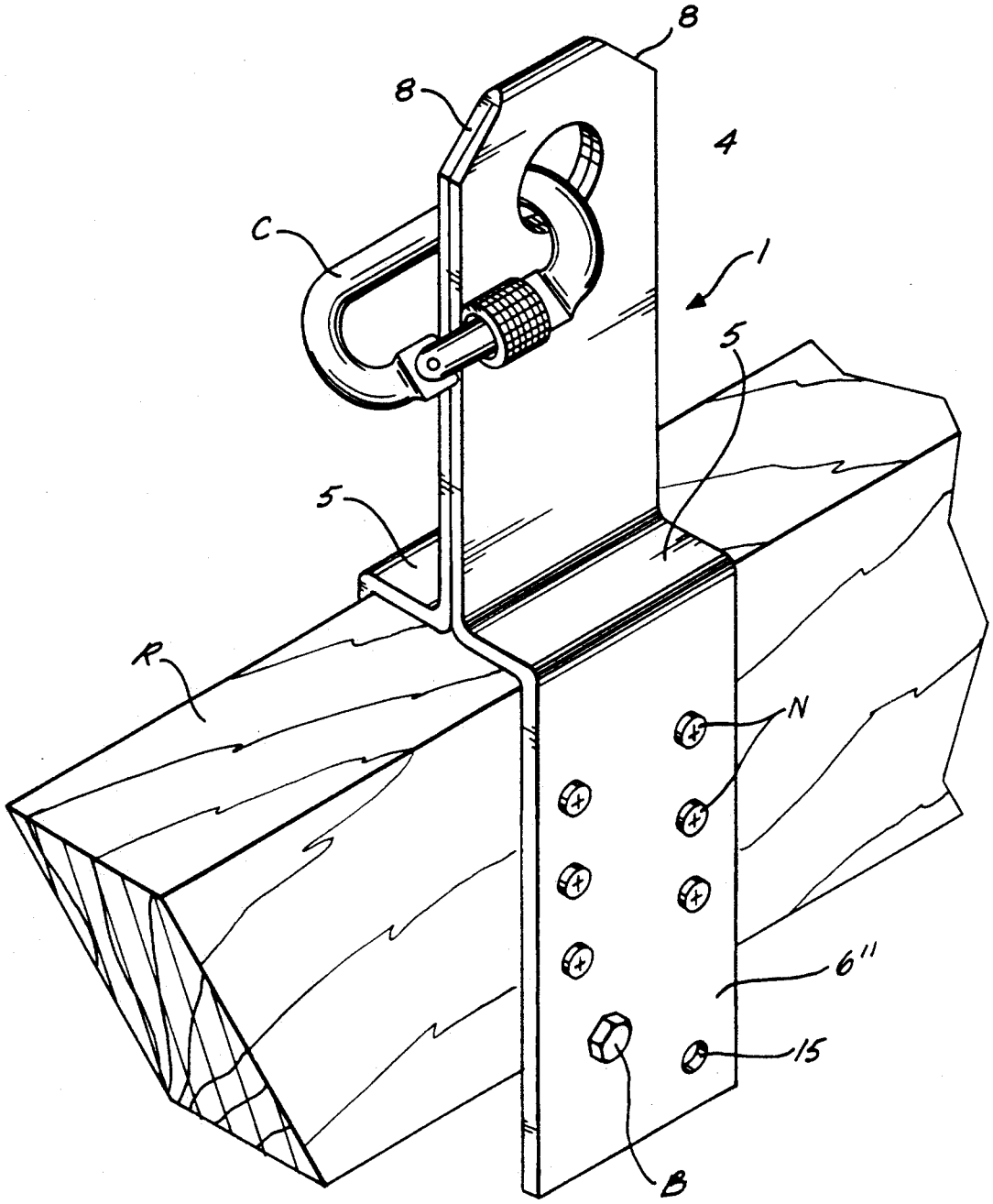
FIG. 13 is a top perspective of still another modified form of fall arrest lifeline roof anchor in accordance with the present invention installed on a rafter before installation of roof sheathing over the rafter.
Figure 14:
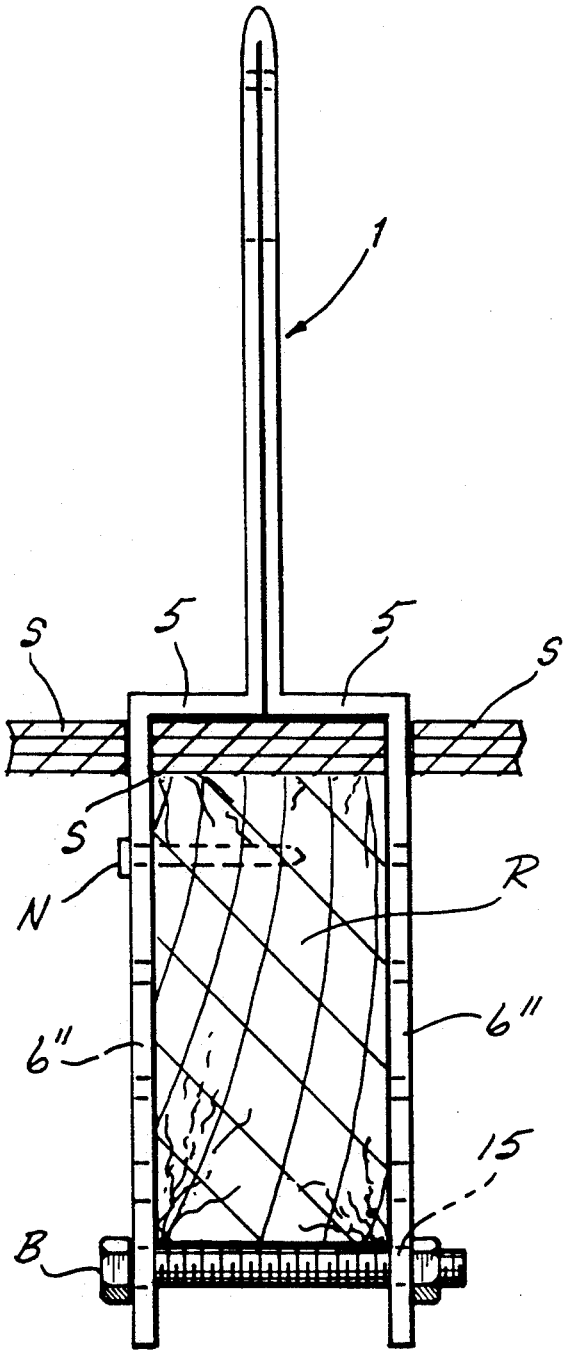
FIG. 14 is an end elevation of the anchor of FIG. 13 illustrating installation of such anchor over roof sheathing supported on a rafter, the rafter being shown in section.

In the form of anchor in accordance with the present invention shown in FIG. 13, the legs 6'' are of a length sufficient to extend downward below the bottom of the rafter R but are not bent inward. Rather, registered apertures are provided for a bolt B to extend close beneath the rafter so as to act similarly to the inturned end portions of the embodiment shown in FIG. 10. One or two bolts can be used so as to reduce the tendency of the anchor to tilt and apply shearing force on the nails N as force is applied in a direction generally parallel to the length of the rafter. The lower hole 15 in FIG. 13 is at the proper location for registered holes for an installation of the type illustrated in FIG. 14 where the anchor is installed over the roof sheathing S. In that manner of installation, there is a greater distance from the aligned anchor shoulders 5 to the underside of the rafter R than if the anchor is installed directly to the rafter before application of the sheathing.

Figure 15:
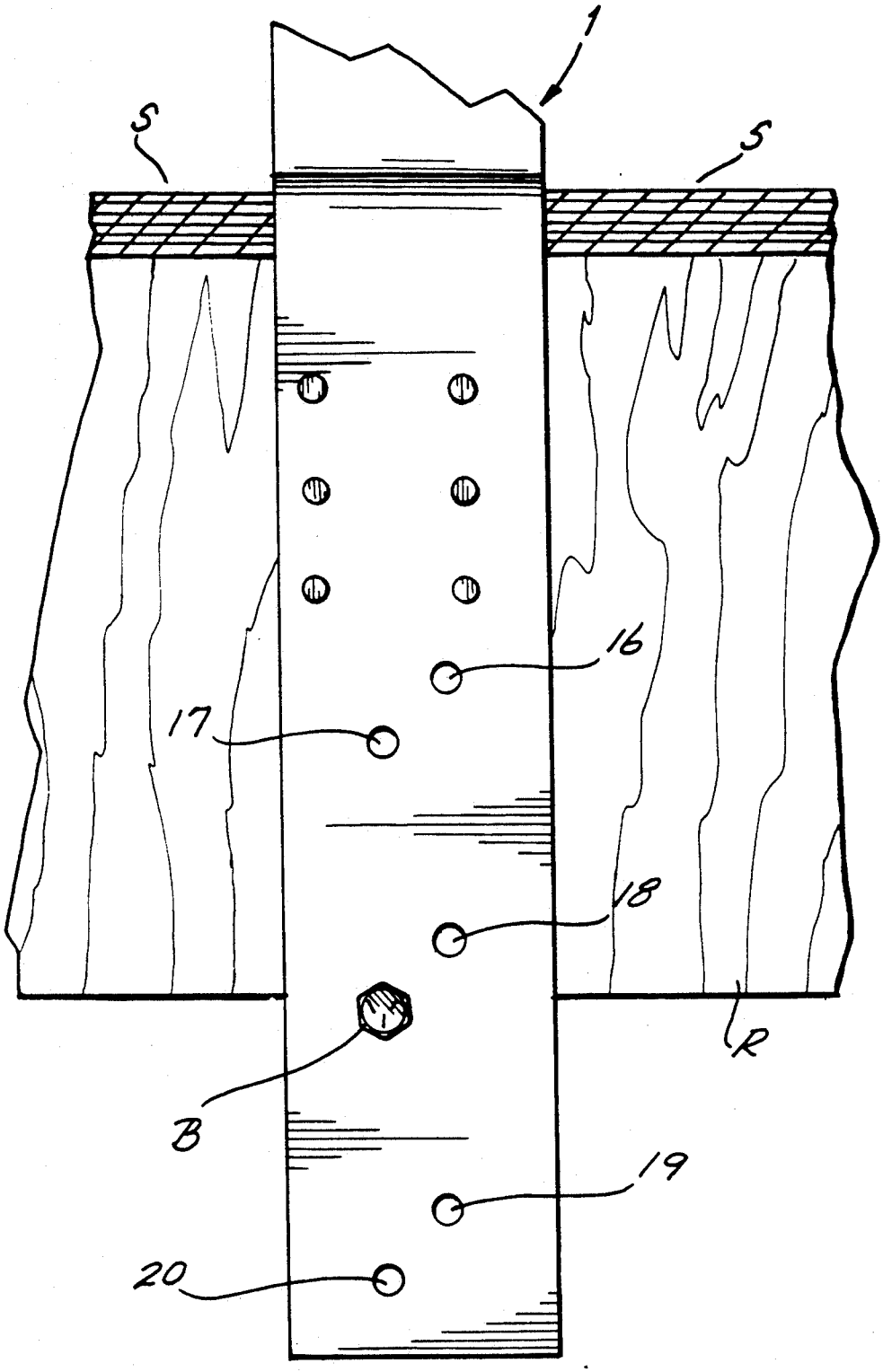
FIG. 15 is a fragmentary side elevation of yet another modified form of fall arrest lifeline roof anchor in accordance with the present invention installed on a roof rafter after installation of roof sheathing.

FIG. 15 illustrates another modified form of anchor in accordance with the present invention. Each leg 6''' has three pairs of bolt apertures for rafters of different depths. The upper pair is positioned to be used with 2×4 rafters stood on end, the upper hole 16 being appropriate for a bolt to extend close beneath the rafter if the anchor is applied directly over the rafter and the lower hole 17 being appropriate for a bolt to extend close beneath the rafter if the anchor is applied over the roof sheathing. The middle pair of holes is positioned so as to be appropriate for a 2×6 rafter stood on end, the upper hole 18 being appropriate if the anchor is applied directly over the rafter and the bottom hole receiving bolt B being appropriate if the anchor member is applied over the roof sheathing as illustrated in FIG. 15. Similarly, the bottom pair of holes 19 and 20 is designed for 2×8 rafters stood on end. For each installation, a bolt extends close beneath the rafter and interconnects the spaced-apart legs to increase resistance to pullout.

The embodiments of the invention in which an exclusive property or privilege is claimed are defined as follows:

1. In a fall prevention safety system including an anchor installed on a roof understructure and a lifeline connected to such anchor, such understructure including a rafter having opposite sides, the improvement comprising the anchor being a bracket having parallel metal strap legs embracing and secured to the opposite sides of the rafter, respectively, said bracket including an elongated central portion extending generally parallel to said legs and projecting from the rafter, said central portion having means for enabling connection of a lifeline to said central portion, and means interconnecting said legs so as to deter relative transverse movement of said legs, said legs including respective portions projecting beyond the rafter in a direction opposite the direction of projection of said central portion of said bracket, and said interconnection means including a bolt extending through said projecting portions of said legs.

2. In the system defined in claim 1, the central portion of the bracket projecting upward from the rafter and the bolt extending close beneath the rafter.

3. In the system defined in claim 1, the bracket legs having through holes, and including connection members driven through such holes into the rafter.

4. In the system defined in claim 1, the bracket having shoulder portions intermediate the legs and the central portion and extending substantially perpendicular thereto.

5. In the system defined in claim 4, the shoulder portions having undersides engaged against the top surface of the rafter.

6. In the system defined in claim 4, a layer of sheathing supported on the rafter and extending over the top of the shoulder portions, the means for connection of the lifeline including an aperture in the central portion which aperture is spaced above the sheathing.

7. In the system defined in claim 4, a layer of sheathing supported on the rafter, the shoulder portions of the bracket being engaged against the upper surface of the sheathing, the legs of the bracket extending downward through the sheathing and having lower end portions secured to opposite sides of the rafter.

8. In the system defined in claim 1, the bracket being formed of a single piece of metal strap having a return bend at the center of said strap, central portions adjacent to said return bend having facing surfaces disposed in substantially contiguous engagement, out-turned shoulder portions bent perpendicularly from said central portions and leg portions bent perpendicularly from said shoulder portions so as to extend from said shoulder portions in a direction opposite the direction in which the central portion extends from said shoulder portions.

9. In a fall prevention safety system including an anchor installed on a roof understructure and a lifeline connected to such anchor, such understructure including a roof rafter having opposite upright sides, the improvement comprising the anchor being a bracket having parallel metal strap legs embracing the opposite upright sides of the rafter, respectively, said bracket including an elongated central portion extending generally parallel to said legs and projecting from the rafter, said central portion having means for enabling connection of the lifeline to said central portion, said bracket further including shoulder portions located between said legs and said central portion to limit insertion of said bracket over the rafter, said leg portions having registered apertures, and a bolt extending through said registered apertures and interconnecting said legs to deter relative transverse movement of said legs.

* * * * *